US009228788B1

(12) United States Patent
Simon et al.

(10) Patent No.: US 9,228,788 B1
(45) Date of Patent: Jan. 5, 2016

(54) AMMUNITION MAGAZINE HAVING GUIDE SURFACES

(71) Applicant: Smith & Wesson Corp., Springfield, MA (US)

(72) Inventors: John B. Simon, Springfield, MA (US); Brett Curry, Monson, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 14/695,706

(22) Filed: Apr. 24, 2015

Related U.S. Application Data

(60) Provisional application No. 62/073,219, filed on Oct. 31, 2014.

(51) Int. Cl.
*F41A 9/70* (2006.01)
*F41A 9/73* (2006.01)

(52) U.S. Cl.
CPC .... *F41A 9/70* (2013.01); *F41A 9/73* (2013.01)

(58) Field of Classification Search
CPC ..... F41A 9/61–9/78
See application file for complete search history.

(56) References Cited

U.S. PATENT DOCUMENTS

| | | | | |
|---|---|---|---|---|
| 483,229 | A | 9/1892 | Lindner | |
| 696,118 | A | 3/1902 | Thorsen | |
| 3,239,959 | A * | 3/1966 | Sefried | F41A 9/73 42/19 |
| 3,562,944 | A | 2/1971 | Wagner et al. | |
| 3,745,687 | A | 7/1973 | Koon, Jr. | |
| 4,079,535 | A * | 3/1978 | Elbe et al. | 42/49.02 |
| 4,314,419 | A * | 2/1982 | Koon, Jr. | 42/50 |
| 4,487,103 | A * | 12/1984 | Atchisson | 89/33.02 |
| 6,502,495 | B1 * | 1/2003 | Beary | F41A 17/36 89/33.17 |
| 7,698,844 | B2 * | 4/2010 | Gruber et al. | 42/50 |
| 8,156,675 | B2 | 4/2012 | Heath | |
| 8,448,364 | B2 * | 5/2013 | Davidson | 42/50 |
| 8,484,875 | B2 | 7/2013 | Heath | |
| 8,745,912 | B2 | 6/2014 | Heath | |
| 2012/0117840 | A1 | 5/2012 | Chewning et al. | |
| 2014/0250752 | A1 | 9/2014 | Heath | |
| 2015/0121736 | A1 * | 5/2015 | Faifer | 42/49.01 |

* cited by examiner

*Primary Examiner* — Troy Chambers
*Assistant Examiner* — Joshua Semick
(74) *Attorney, Agent, or Firm* — John A. Chionchio, Esq.; Ballard Spahr LLP

(57) ABSTRACT

A magazine for a firearm is formed by a plurality of sidewalls that define a space for holding ammunition cartridges. An opening between two of the walls provides access to the space. Feed lips are positioned on opposite sides of the opening. The feed lips contact and retain the cartridges within the space. Feed ramp surfaces are positioned on opposite sides of the opening. The feed ramp surfaces are angularly oriented to tilt a cartridge so that it may be fed into the chamber of a barrel as it is pushed out of the opening along the feed ramp surfaces. Guide surfaces are positioned on opposite sides of the opening between the feed lips and the feed ramp surfaces. The guide surfaces guide the cartridge as it disengages from the feed lips and moves up along the feed ramp surfaces.

17 Claims, 4 Drawing Sheets

AMMUNITION MAGAZINE HAVING GUIDE SURFACES

CROSS REFERENCE TO RELATED APPLICATIONS

This application is a non-provisional of and claims benefit of priority to U.S. Provisional Patent Application No. 62/073,219, filed Oct. 31, 2014, which provisional application is hereby incorporated by reference herein.

FIELD OF THE INVENTION

This invention relates to ammunition magazines, and in particular, magazines for push-feed firearms.

BACKGROUND

During operation of a so-called "push-feed firearm" an ammunition cartridge is substantially unguided in its travel between the magazine and the chamber after leaving the magazine's feed lips which otherwise retain the cartridges within the magazine. Push-feed firearms contrast with controlled-feed firearms in that during operation of a controlled-feed firearm the cartridge is held first by the magazine feed lips and then held by the extractor as the cartridge is chambered, thereby ensuring proper and reliable ammunition feed during cycling of the firearm action.

The substantially unguided nature of ammunition feed in the push-feed firearm allows a cartridge to be pushed laterally out of alignment with the bolt and chamber by cartridges following the cartridge being chambered as well as by the magazine follower when the cartridge is the last round in the magazine. This effect can be particularly troublesome in prior art rotary magazines 10, as shown in FIG. 1, when feeding the last cartridge 12 in the magazine. As shown in the cross section of FIG. 1A, the follower paddle 14 rotates counter-clockwise (in this view) when advancing the cartridges 12, and the natural effect of this rotary motion is to push the cartridge toward the left (in this view) once it is clear of the feed lips 16 and 18. Mis-feeds often result when the paddle 14 kicks the cartridge head off of the bolt. The cartridge is then caught between the advancing bolt head and the front wall of the ejection port. Shorter and relatively lightweight cartridges are especially prone to this type of feed failure. This problem is also encountered in the case of feeding cartridges prior to the last round due to lateral force imparted from the cartridges advanced by the follower and rising under the feeding cartridge.

Prior art push-feed magazines are also prone to other failure modes. For example, a cartridge can simply drop from the action on its way into the chamber if the rifle is held on its side with the ejection port down. There is clearly an opportunity for improvement in magazines for push-feed firearms.

SUMMARY

The invention concerns a magazine for a firearm for holding a plurality of ammunition cartridges. In one example embodiment the magazine comprises a plurality of sidewalls defining a space for holding the cartridges. An opening is defined between a first and a second of the sidewalls providing access to the space. A spring-biased follower is positioned within the space for urging the cartridges held within the space toward the opening. In this example, first and second feed lips are positioned on the first and second sidewalls on opposite sides of the opening. The feed lips project toward one another so as to contact and retain at least one of the cartridges within the space. The feed lips extend lengthwise along a first portion of the opening. A first guide surface is positioned on the first sidewall adjacent to the first feed lip. The first guide surface extends lengthwise along a second portion of the opening and projects away from the space so as to guide the cartridges once disengaged from the feed lips.

In one example embodiment, the first guide surface is contiguous with the first feed lip. In a particular example embodiment, the first guide surface comprises a continuous surface. A specific example embodiment further comprises first and second feed ramp surfaces positioned on opposite sides of the opening. The first and second feed ramp surfaces are angularly oriented with respect to the first and second feed lips. The first feed ramp surface is positioned on the first sidewall, and the second feed ramp surface is positioned on the second sidewall. The first guide surface is positioned between the first feed lip and the first feed ramp surface.

In an example embodiment the first guide surface is contiguous with the first feed ramp surface. Another example embodiment comprises a second guide surface positioned on the second sidewall adjacent to the second feed lip. The second guide surface extends lengthwise along the second portion of the opening and projects away from the space so as to guide the cartridges once disengaged from the feed lips. In a specific example embodiment the second guide surface is contiguous with the second feed lip. In another example embodiment the second guide surface comprises a continuous surface.

By way again of example, the magazine according to the invention further comprises first and second feed ramp surfaces positioned on opposite sides of the opening. The first and second feed ramp surfaces are angularly oriented with respect to the first and second feed lips. The first feed ramp surface is positioned on the first sidewall, and the second feed ramp surface positioned on the second sidewall. In this example the first guide surface is positioned between the first feed lip and the first feed ramp surface, and the second guide surface is positioned between the second feed lip and the second feed ramp surface.

In another example embodiment the first guide surface is contiguous with the first feed ramp surface. By way of further example, the second guide surface is contiguous with the second feed ramp surface.

In a particular example embodiment, the follower comprises a paddle rotatable about an axis aligned lengthwise along the opening.

The invention further encompasses a magazine for a firearm for holding a plurality of ammunition cartridges. In this further example embodiment the magazine comprises a plurality of sidewalls defining a space for holding the cartridges. An opening is defined between a first and a second of the sidewalls providing access to the space. A spring-biased follower is positioned within the space for urging the cartridges held within the space toward the opening. First and second feed lips are positioned on the first and second sidewalls on opposite sides of the opening. The feed lips project toward one another so as to contact and retain at least one of the cartridges within the space. The feed lips extend lengthwise along a first portion of the opening. First and second guide surfaces are positioned respectively on the first and second sidewalls adjacent to the first and second feed lips. The first and second guide surfaces extend lengthwise along a second portion of the opening and projecting away from the space so as to guide the cartridges once disengaged from the feed lips.

An example embodiment of the magazine further comprises first and second feed ramp surfaces positioned on opposite sides of the opening. The first and second feed ramp surfaces are angularly oriented with respect to the first and second feed lips. The first feed ramp surface is positioned on the first sidewall, and the second feed ramp surface positioned on the second sidewall. The first guide surface is positioned between the first feed lip and the first feed ramp surface, and the second guide surface is positioned between the second feed lip and the second feed ramp surface.

In a specific example embodiment, the follower comprises a paddle rotatable about an axis aligned lengthwise along the opening.

In a specific example embodiment the first guide surface is contiguous with the first feed lip. Further by way of example, the second guide surface is contiguous with the second feed lip. In a particular example embodiment the first guide surface comprises a continuous surface. In another example, the second guide surface comprises a continuous surface. By way of further example, the first guide surface is contiguous with the first feed ramp surface. Again by way of example, the second guide surface is contiguous with the second feed ramp surface.

DETAILED DESCRIPTION

Figure 1:
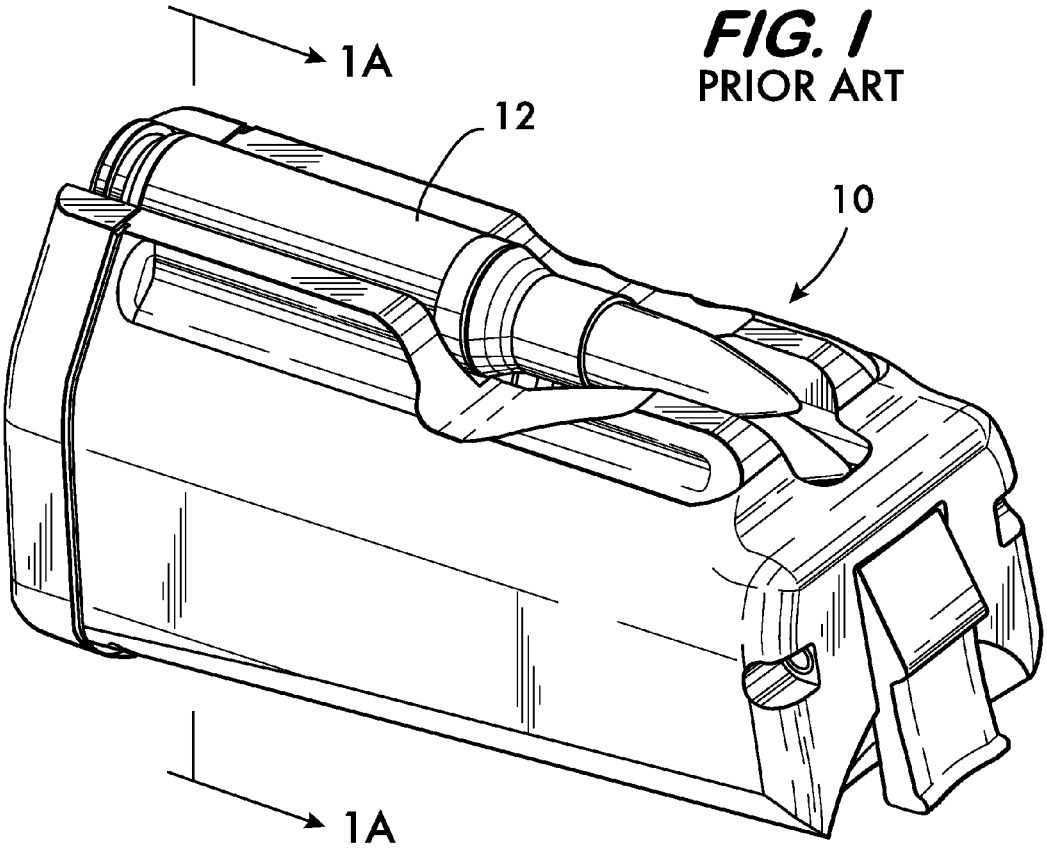
FIG. 1 PRIOR ART
FIG. 1 is an isometric view of an ammunition magazine according to the prior art.
Figure 1A:
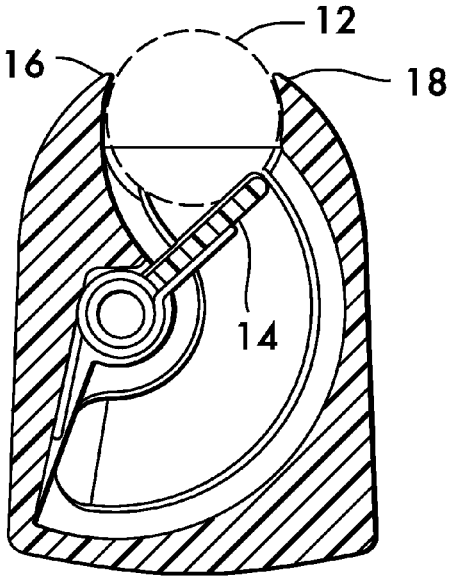
FIG. 1A PRIOR ART
FIG. 1A is a cross sectional view taken at line 1A-1A of FIG. 1.
Figure 2:
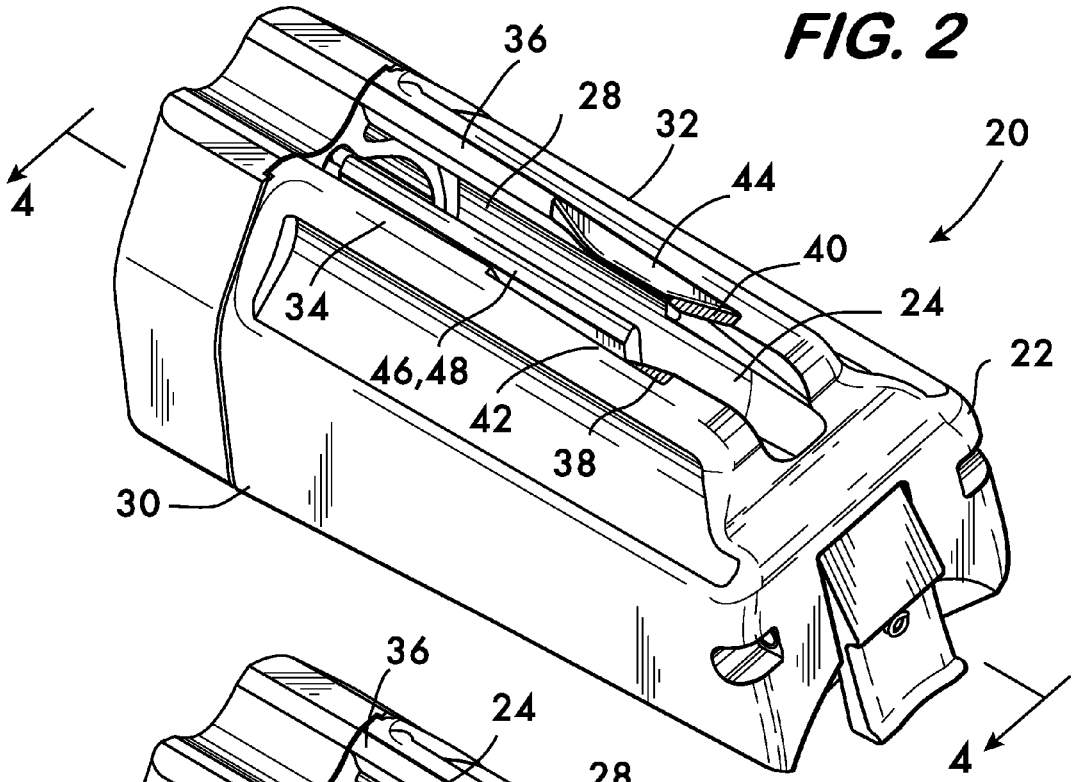
FIGS. 2 and 3 are isometric views of an example embodiment of an ammunition magazine according to the invention.
Figure 3:
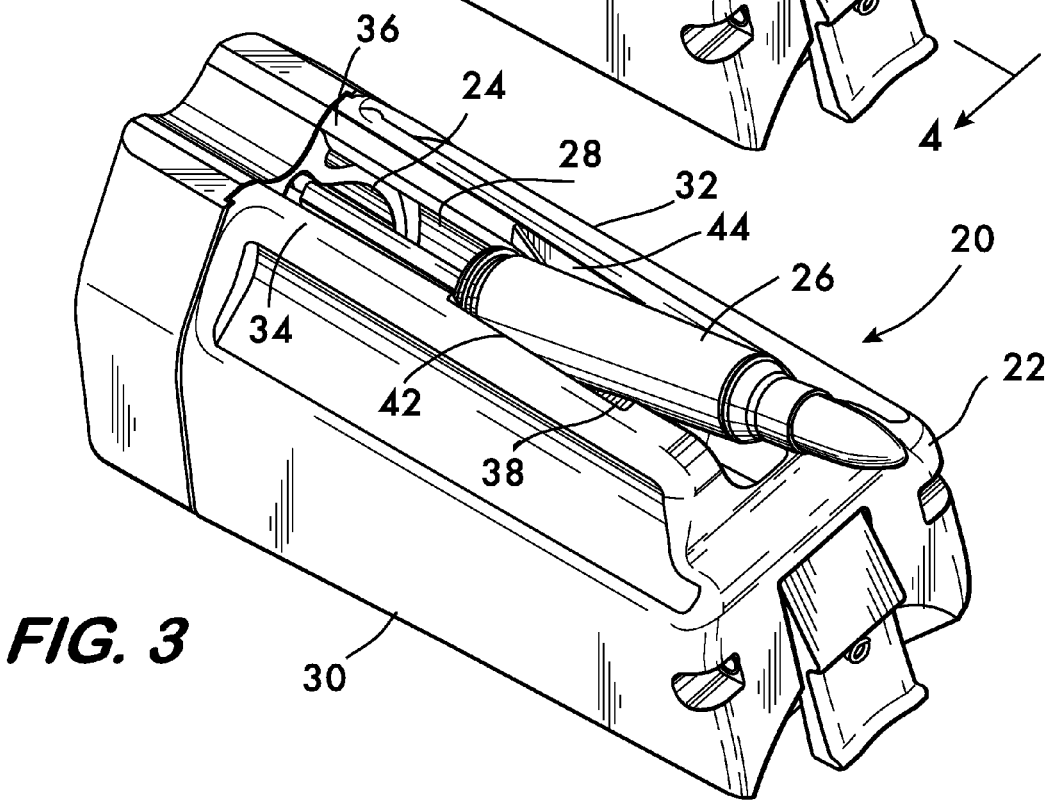
Figure 3A:
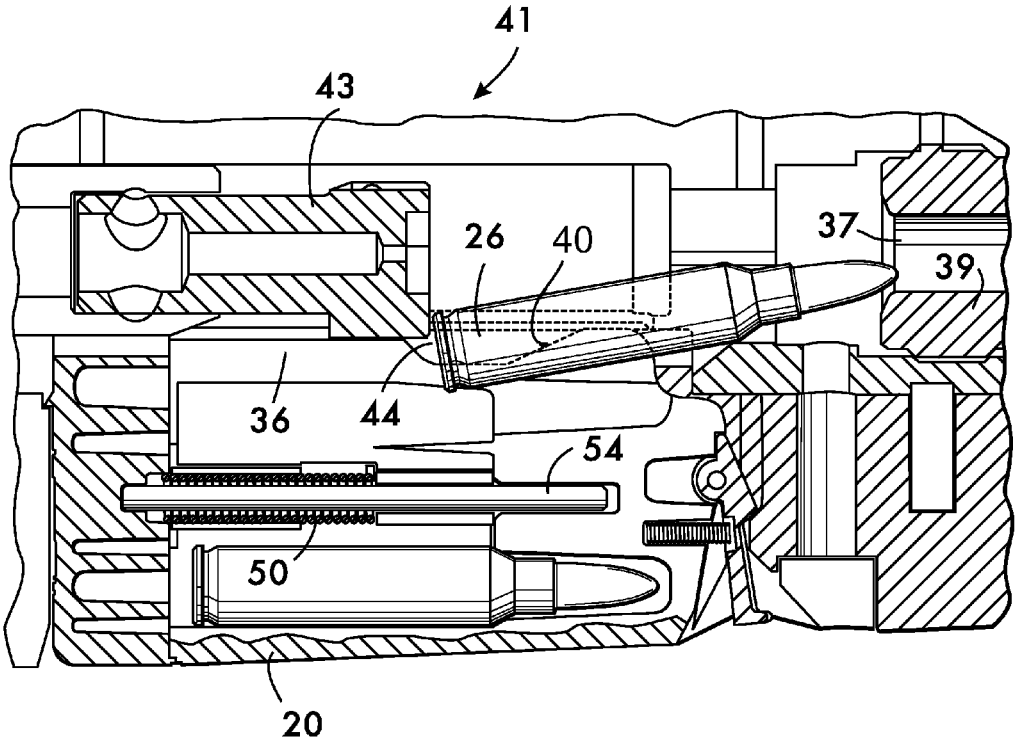
FIG. 3A is a longitudinal sectional elevational view of the magazine of FIGS. 2 and 3 positioned within a firearm.

FIG. 2 shows an example embodiment of an ammunition magazine 20 according to the invention. Magazine 20 comprises a plurality of sidewalls 22 defining a space 24 for holding cartridges 26 (see FIG. 3). An opening 28 is defined between a first sidewall 30 and a second sidewall 32, opening 28 providing access to the space 24 for loading and removing cartridges to and from the magazine 20. First and second feed lips 34 and 36 are respectively positioned on the first and second sidewalls 30 and 32. Feed lips 34 and 36 project toward one another so as to contact and retain the cartridges within the space 24. The feed lips 34 and 36 extend lengthwise along only a portion of the opening 28 rather than continuing along its full length. As shown in FIGS. 3 and 3A, the length of the feed lips 34 and 36 is limited due to the tip-up orientation of the cartridge 26 required to point the cartridge 26 toward the chamber 37 in the barrel 39 of a firearm 41, the chamber being above the topmost cartridge 26 as it sits in the magazine 20. The tip-up orientation of cartridge 26 is effected by first and second feed ramp surfaces 38 and 40 positioned on opposite sides of opening 28 as shown in FIGS. 2 and 3. First feed ramp surface 38 is positioned on the first sidewall 30 and the second feed ramp surface 40 is positioned on the second side wall 32. Both feed ramp surfaces 38 and 40 extend lengthwise along opening 28 and are angularly oriented relatively to the feed lips 34 and 36. As shown in FIGS. 3 and 3A, the angular orientation of the feed ramp surfaces 38 and 40 orients the cartridge 26 in the tip-up orientation as it is stripped from the magazine 20 by a bolt 43 and forced against the feed ramp surfaces. As the front of the cartridge 26, once clear of the feed lips 34 and 36, rises, the rear of the cartridge lowers. Upon leaving the guidance of the feed lips 34 and 36 the rear of the cartridge 26 also rises and maintains contact with the bolt 43 pushing it, thus preventing an override failure wherein the bolt overrides the rear (case head) of the cartridge 26.

As shown in FIG. 2, to prevent cartridge 26 from being pushed laterally out of alignment with the bolt and chamber during ammunition feeding, first and second guide surfaces 42 and 44 are respectively positioned on the first and second sidewalls 30 and 32. First and second guide surfaces 42 and 44 extend along opposite sides of a second portion of the opening 28. The first guide surface 42 is positioned between the first feed lip 34 and the first feed ramp surface 38; the second guide surface 44 is positioned between the second feed lip 36 and the second feed ramp surface 40. In this example embodiment the first guide surface 42 is contiguous with both the first feed lip 34 and the first feed ramp surface 38. Similarly, the second guide surface 44 is contiguous with both the second feed lip 36 and the second feed ramp surface 40. Other structures for guide surfaces 42 and 44 are of course feasible. For example, the guide surfaces could be discontinuous surfaces positioned between the feed lips and the feed ramp surfaces. Guide surfaces 42 and 44 project away from the space 24 but do not project toward one another like the feed lips 34 and 36 so that the guide surfaces do not interfere with motion of the cartridges 26 out of the space 24. The guide surfaces 42 and 44 limit the lateral motion of the cartridges 26 so that they remain aligned with the bolt and barrel as a cartridge is stripped from the magazine 20. While two guide surfaces 42 and 44 arranged on opposite sides of the opening 28 are considered advantageous, an embodiment with only one guide surface would also be feasible.

Figure 4:
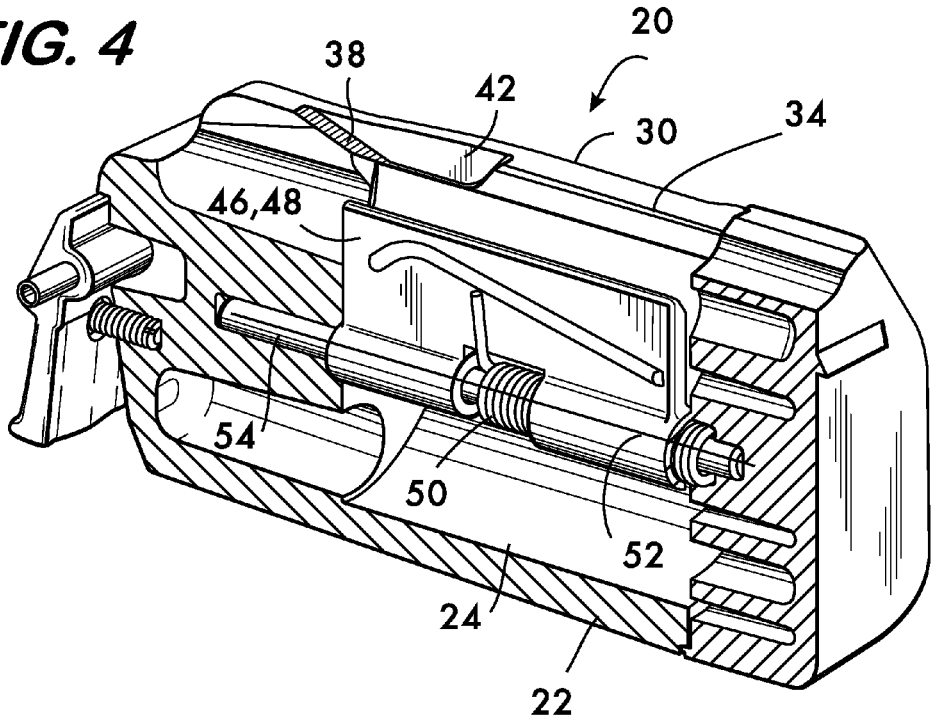
FIG. 4 is a longitudinal sectional isometric view of the ammunition magazine taken at line 4-4 of FIG. 2.
Figure 4A:
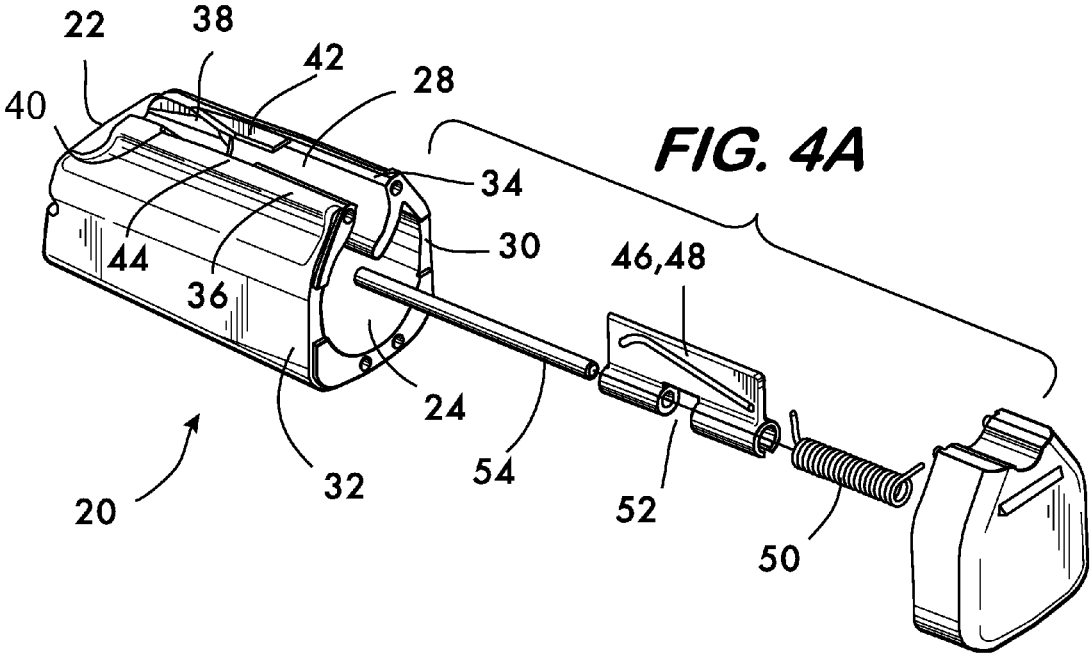
FIG. 4A is an exploded isometric view of the ammunition magazine of FIG. 2.

As shown in FIGS. 4 and 4A, magazine 20 further comprises a spring-biased follower 46. In this example embodiment the magazine 20 is a rotary magazine and thus the follower 46 comprises a paddle 48 biased by a torsion spring 50 and rotatable about an axis 52 defined by an axle 54 mounted within the space 24 of magazine 20. Spring 50 biases the paddle 48 in a clockwise direction in the views shown in FIGS. 4 and 4A, and, but for the presence of at least the first guide surface 42, the paddle would tend to push a cartridge to the right and out of alignment with the bolt and barrel once the cartridge was clear of the feed lips 34 and 36, potentially causing a mis-feed. In the case of a round being fed with the firearm's ejection port facing downward towards the ground, the additional guidance provided by the guide surfaces 42 and 44 is expected to help retain the round in the action and ensure proper feeding. Although a rotary magazine is illustrated, this is by way of example only, it being understood that the guide surfaces of the invention could be used with other types of magazines having other types of followers.

What is claimed is:

1. A magazine for a firearm, said magazine for holding a plurality of ammunition cartridges, said magazine comprising:

a plurality of sidewalls defining a space for holding said cartridges;

an opening defined between a first and a second of said sidewalls providing access to said space;

a spring-biased follower positioned within said space for urging said cartridges held within said space toward said opening, said follower comprising a paddle rotatable about an axis aligned lengthwise along said opening;

first and second feed lips positioned on said first and second sidewalls on opposite sides of said opening, said feed lips projecting toward one another so as to contact and retain at least one of said cartridges within said space, said feed lips extending lengthwise along a first portion of said opening;

a first guide surface positioned on said first sidewall adjacent to said first feed lip, said first guide surface extending lengthwise along a second portion of said opening and projecting away from said space so as to guide said cartridges once disengaged from said feed lips;

first and second feed ramp surfaces positioned on opposite sides of said opening, said first and second feed ramp surfaces being angularly oriented with respect to said first and second feed lips, said first feed ramp surface positioned on said first sidewall, said second feed ramp surface positioned on said second sidewall, said first guide surface being positioned between said first feed lip and said first feed ramp surface.

2. The magazine according to claim 1, wherein said first guide surface is contiguous with said first feed lip.

3. The magazine according to claim 1, wherein said first guide surface comprises a continuous surface.

4. The magazine according to claim 1, wherein said first guide surface is contiguous with said first feed ramp surface.

5. The magazine according to claim 1, further comprising a second guide surface positioned on said second sidewall adjacent to said second feed lip, said second guide surface extending lengthwise along said second portion of said opening and projecting away from said space so as to guide said cartridges once disengaged from said feed lips.

6. The magazine according to claim 5, wherein said second guide surface is contiguous with said second feed lip.

7. The magazine according to claim 5, wherein said second guide surface comprises a continuous surface.

8. The magazine according to claim 5, further comprising first and second feed ramp surfaces positioned on opposite sides of said opening, said first and second feed ramp surfaces being angularly oriented with respect to said first and second feed lips, said first feed ramp surface positioned on said first sidewall, said second feed ramp surface positioned on said second sidewall, said first guide surface being positioned between said first feed lip and said first feed ramp surface, said second guide surface being positioned between said second feed lip and said second feed ramp surface.

9. The magazine according to claim 8, wherein said first guide surface is contiguous with said first feed ramp surface.

10. The magazine according to claim 9, wherein said second guide surface is contiguous with said second feed ramp surface.

11. A magazine for a firearm, said magazine for holding a plurality of ammunition cartridges, said magazine comprising:

a plurality of sidewalls defining a space for holding said cartridges;

an opening defined between a first and a second of said sidewalls providing access to said space;

a spring-biased follower positioned within said space for urging said cartridges held within said space toward said opening, said follower comprising a paddle rotatable about an axis aligned lengthwise along said opening;

first and second feed lips positioned on said first and second sidewalls on opposite sides of said opening, said feed lips projecting toward one another so as to contact and retain at least one of said cartridges within said space, said feed lips extending lengthwise along a first portion of said opening;

first and second guide surfaces positioned respectively on said first and second sidewalls adjacent to said first and second feed lips, said first and second guide surfaces extending lengthwise along a second portion of said opening and projecting away from said space so as to guide said cartridges once disengaged from said feed lips;

first and second feed ramp surfaces positioned on opposite sides of said opening, said first and second feed ramp surfaces being angularly oriented with respect to said first and second feed lips, said first feed ramp surface positioned on said first sidewall, said second feed ramp surface positioned on said second sidewall, said first guide surface being positioned between said first feed lip and said first feed ramp surface, said second guide surface being positioned between said second feed lip and said second feed ramp surface.

12. The magazine according to claim 11, wherein said first guide surface is contiguous with said first feed lip.

13. The magazine according to claim 12, wherein said second guide surface is contiguous with said second feed lip.

14. The magazine according to claim 11, wherein said first guide surface comprises a continuous surface.

15. The magazine according to claim 14, wherein said second guide surface comprises a continuous surface.

16. The magazine according to claim 11, wherein said first guide surface is contiguous with said first feed ramp surface.

17. The magazine according to claim 16, wherein said second guide surface is contiguous with said second feed ramp surface.

* * * * *